US006718916B2

(12) United States Patent
Hewkin

(10) Patent No.: US 6,718,916 B2
(45) Date of Patent: Apr. 13, 2004

(54) CONTAINER FOR THE COOLANT OF AN INTERNAL COMBUSTION ENGINE

(75) Inventor: David R. Hewkin, Kalamazoo, MI (US)

(73) Assignee: Mann & Hummel Automotive, Inc., Portage, MI (US)

( * ) Notice: Subject to any disclaimer, the term of this patent is extended or adjusted under 35 U.S.C. 154(b) by 0 days.

(21) Appl. No.: 10/152,351

(22) Filed: May 22, 2002

(65) Prior Publication Data

US 2002/0189559 A1 Dec. 19, 2002

Related U.S. Application Data

(60) Provisional application No. 60/292,516, filed on May 23, 2001.

(51) Int. Cl.[7] ..... F01P 11/02
(52) U.S. Cl. ..... 123/41.54
(58) Field of Search ..... 123/41.54; 165/104.32

(56) References Cited

U.S. PATENT DOCUMENTS 4,723,596 A 2/1988 Spindelboeck et al.
4,738,228 A 4/1988 Jenz et al.
4,739,730 A 4/1988 Jenz et al.
5,088,453 A * 2/1992 Kleineberg et al. ..... 123/41.54
5,680,833 A 10/1997 Smith
5,829,268 A 11/1998 Mertens
6,056,139 A 5/2000 Gericke

FOREIGN PATENT DOCUMENTS

WO 99/10636 3/1999

* cited by examiner

*Primary Examiner*—Noah P. Kamen
(74) *Attorney, Agent, or Firm*—Crowell & Moring LLP

(57) ABSTRACT

A container for the coolant of an internal combustion engine including a first chamber (11), which forms the coolant reservoir and has a connection to a radiator. The first chamber is equipped with a sealing cap (19), and the sealing cap seals the first chamber via a threaded, bayonet or snap connection. An additional chamber (15) is provided as an overflow reservoir, which communicates with the first chamber (11) and which is equipped with an outlet. A third chamber (16) is arranged within the container, which at its geodetically lower end has a connection in the form of an opening to the second chamber (15). This third chamber (16) communicates with the first chamber (11) via an interposed pressure relief valve (20).

12 Claims, 1 Drawing Sheet

CONTAINER FOR THE COOLANT OF AN INTERNAL COMBUSTION ENGINE

CROSS REFERENCE TO RELATED APPLICATIONS

This application claims the benefit of prior U.S. provisional application No. 60/292,516, filed May 23, 2001.

BACKGROUND OF THE INVENTION

The present invention relates to a multi-chamber container for the coolant of an internal combustion engine.

Such a container is known, for example, from U.S. Pat. No. 5,680,833. These containers form a coolant reservoir and are connected via a line to the radiator of an internal combustion engine. The container ensures that the radiator of the internal combustion engine is always optimally filled and that a certain amount of coolant is available in addition. Typically, the container has a first chamber into which the coolant can be filled. Another chamber is provided as an overflow reservoir. This chamber communicates with the first chamber via a hose connection. A drawback of this system is that any accidental detachment of the hose causes the first chamber and thus the coolant reservoir to loose fluid, so that cooling of the internal combustion engine is jeopardized.

A further drawback is that the hose connection is complex and thus uneconomical.

SUMMARY OF THE INVENTION

The object of the invention is to provide an improved container for the coolant of an internal combustion engine.

Another object of the invention is to provide a coolant container which can be manufactured economically and which works reliably under various operating conditions.

These and other objects are achieved in accordance with the present invention by providing a coolant container for an internal combustion engine, comprising a first chamber which forms a coolant reservoir and which has a connection for connection to a radiator; a second chamber which forms an overflow reservoir and which communicates with the first chamber and is provided with an outlet; a third chamber which at a geodetically lower end thereof has a connection in the form of an opening to the second chamber, and a pressure relief valve interposed between the third chamber and the first chamber through which the third chamber communicates with the first chamber.

The essential advantage of the invention is that a third chamber is arranged within the container, which replaces the hose connection and works reliably without adding greater complexity. The container for the coolant has a pressure relief valve. The third chamber communicates with the first chamber via the pressure relief valve. The pressure relief valve limits the outflow of fluid from the first chamber below a certain preset pressure value. According to one embodiment of the invention, this pressure relief valve is arranged in the sealing cap of the coolant reservoir or container.

According to another embodiment, the third chamber is constructed with a tubular cross section and is located on the wall between the first and the second chamber. The construction or the production process for this third chamber is simple and economical. It is sufficient to provide the partition between the first and the second chamber with an additional tubular profile. The container is preferably made of a thermoplastic material and may be produced from two parts, namely a lower and an upper container half. The two container halves are welded or glued together. Since the second chamber has an outlet for discharging excess coolant, this chamber is unpressurized. The same is true for the third chamber.

These and other features of preferred embodiments of the invention, in addition to being set forth in the claims, are also disclosed in the specification and/or the drawings, and the individual features each may be implemented in embodiments of the invention either alone or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail with reference to an illustrative preferred embodiment shown in the accompanying drawing figures in which.

DETAILED DESCRIPTION OF PREFERRED EMBODIMENTS

Figure 1:
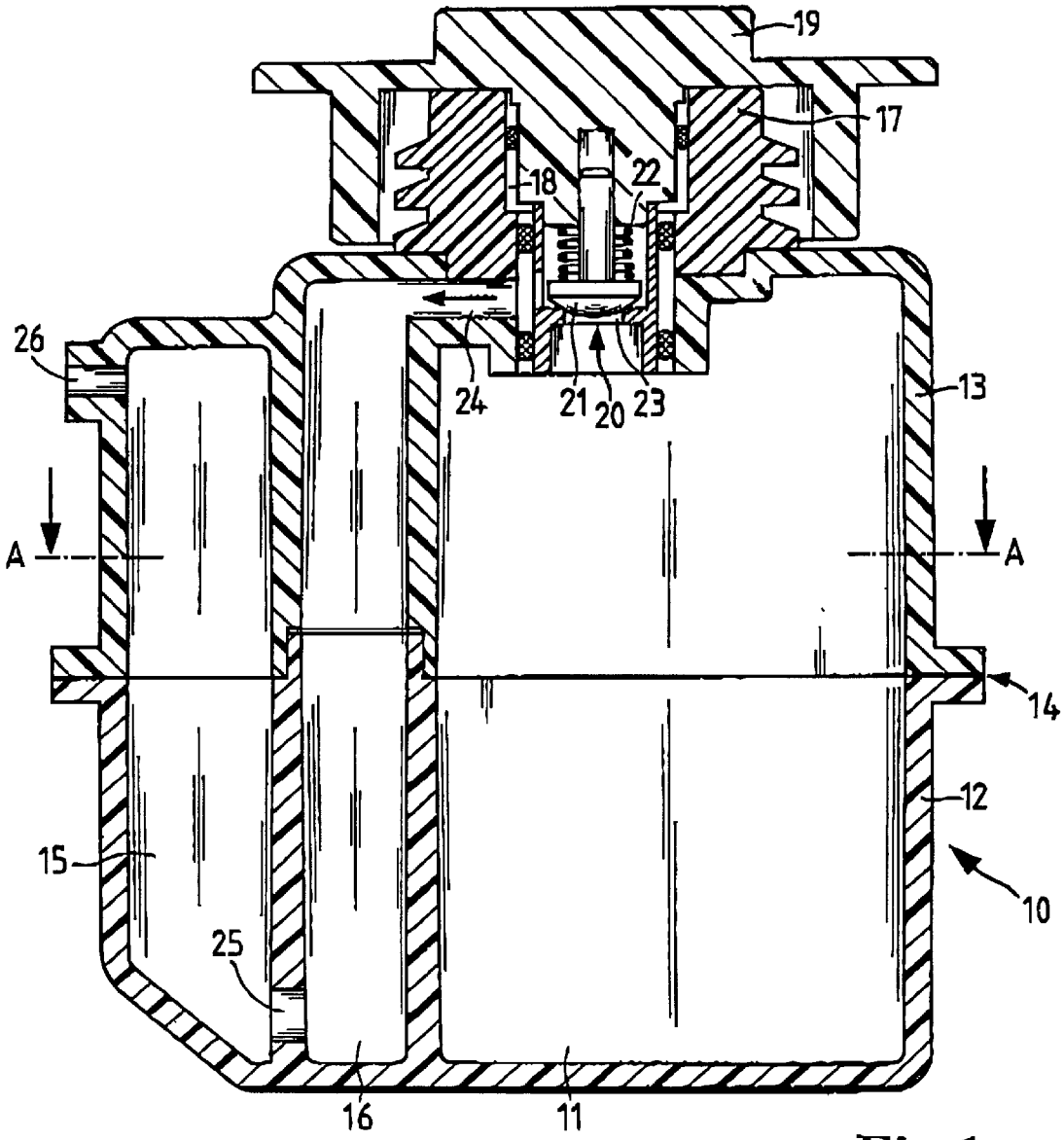
FIG. 1 is a sectional view of a container for the coolant of an internal combustion engine.

Container 10 is comprised of a lower container half 12 and an upper container half 13. Both container halves are provided with flange joints 14 in their central area. The two container halves are connected to one another by ultrasonic welding in the area of the flange connection to provide a liquid-tight seal. Container 10 thus forms a first chamber 11, a second chamber 15, and a third chamber 16. A threaded neck 17 with an opening 18 is provided in the upper area for filling the fluid into the container 10. A sealing cap 19 is placed on the opening 18. The sealing cap is equipped with a pressure relief valve 20. This pressure relief valve 20 comprises a valve disk 21, which is longitudinally displaceable inside sealing cap 19. Furthermore, a compression spring 22 is provided, which exerts a force on the valve disk in axial direction. The valve disk seals a valve opening 23 in sealing cap 19. At an overpressure in chamber 11 exceeding a certain predetermined value, pressure relief valve 20 opens and unblocks a connecting channel 24 between the first chamber 11 and the third chamber 16. The third chamber 16 along its lower area is connected to the second chamber 15 via an opening 25. The second chamber 15 at its geodetically upper end is equipped with an outlet 26.

Figure 2:
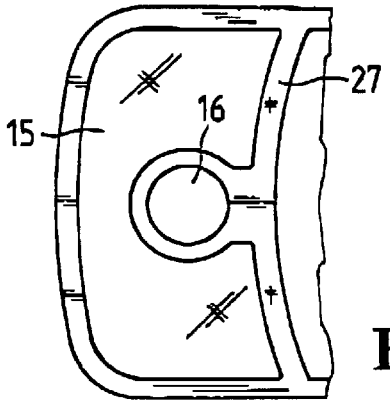
FIG. 2 is a sectional view along line AA.

FIG. 2 shows the arrangement of the third chamber 16 within the second chamber 15. The third chamber is constructed in the form of a tubular profile along partition 27. It may be clearly seen from the drawing that this third chamber serves to create a connection between the first and the second chamber, which is suitable to return fluid from the second chamber to the first chamber if the pressure drops in the first chamber. To this end, the pressure relief valve 20 is provided with a return flap, which allows the fluid to return to the first chamber via the connecting channel. The container is preferably made of transparent plastic, so that the fluid level can be checked without the sealing cap having to be removed. The first chamber is connected to the radiator of the internal combustion engine via an opening (not shown) and ensures that sufficient coolant is present in the radiator.

The foregoing description and examples have been set forth merely to illustrate the invention and are not intended to be limiting. Since modifications of the described embodiments incorporating the spirit and substance of the invention may occur to persons skilled in the art, the invention should be broadly construed to include all variations falling with the scope of the appended claims and equivalents thereof.

What is claimed is:

1. A coolant container for an internal combustion engine, comprising a first chamber which forms a coolant reservoir and which has a connection for connection to a radiator;

a second chamber which forms an overflow reservoir and which communicates with the first chamber and is provided with an outlet;

a third chamber which at a geodetically lower end has a connection in the form of an opening to the second chamber;

a pressure relief valve interposed between the third chamber and the first chamber through which the third chamber communicates with the first chamber;

wherein the third chamber has a tubular cross section and is arranged on a wall between the first chamber and the second chamber; and wherein the container is constructed of joined upper and lower sections of a thermoplastic synthetic resin material.

2. A coolant container according to claim 1, wherein the first chamber has an opening provided with a sealing cap.

3. A coolant container according to claim 2, wherein the sealing cap is attached to the chamber opening by a threaded connection.

4. A coolant container according to claim 2, wherein the sealing cap is attached to the chamber opening by a bayonet connection.

5. A coolant container according to claim 2, wherein the sealing cap is attached to the chamber opening by a snap connection.

6. A coolant container according to claim 2, wherein the pressure relief valve is arranged in the sealing cap.

7. A coolant container according to claim 2, wherein the second and third chambers are unpressurized.

8. A coolant container according to claim 1, wherein the joined upper and lower sections are welded together.

9. A coolant container according to claim 1, wherein the joined upper and lower sections are adhesively bonded together.

10. A coolant container according to claim 1, wherein the second and third chambers are unpressurized.

11. A coolant container according to claim 1, wherein the third chamber is arranged within the container.

12. A coolant container according to claim 1, wherein the third chamber is arranged within the second chamber.

* * * * *